US006699070B1

(12) United States Patent
Wu

(10) Patent No.: US 6,699,070 B1
(45) Date of Patent: Mar. 2, 2004

(54) ELECTRICAL CONNECTOR HAVING MEANS FOR SECURELY MOUNTING THE CONNECTOR TO AN EDGE OF A PRINTED CIRCUIT BOARD

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 29 days.

(21) Appl. No.: 10/215,975

(22) Filed: Aug. 8, 2002

(51) Int. Cl.[7] ..... H01R 13/73
(52) U.S. Cl. ..... 439/574; 439/79; 439/572
(58) Field of Search ..... 439/79, 569, 570, 439/574, 571, 572

(56) References Cited

U.S. PATENT DOCUMENTS 4,134,632 A * 1/1979 Lindberg et al. ..... 439/79
5,083,933 A 1/1992 Colleran et al.
5,501,606 A 3/1996 Oda et al.
5,503,569 A 4/1996 Huss et al.
5,692,912 A 12/1997 Nelson et al.
6,024,605 A 2/2000 Beck et al.
6,036,538 A * 3/2000 Lin ..... 439/574
6,074,237 A 6/2000 Lee
6,120,319 A 9/2000 Lee et al.
6,126,479 A 10/2000 Lee
6,171,133 B1 * 1/2001 Altuner et al. ..... 439/381
6,341,881 B1 * 1/2002 Huang ..... 362/391

* cited by examiner

*Primary Examiner*—Gary Paumen
(74) *Attorney, Agent, or Firm*—Wei Te Chung

(57) ABSTRACT

An electrical connector (1) comprises an insulative housing (3) with a front surface (302) and a rear surface (303) and a locker (4). The insulative housing defines a plurality of passageways (305) and channels (308). A plurality of contacts (6, 7) is secured in the passageways and channels. First, second and third projections (34, 36, 38) are configured in rows and parallel to the front and rear surfaces. The locker comprises an inner surface (44) being attached to the housing and a plurality of grooves (400, 402) depressed from the inner surface. Each groove defines a protrusion (404, 407). The protrusions are retained between the first and second rows of projections (34, 36) before the connector is mounted to a PCB (2), and moved to securely engage with the third row of projections (38) after the connector is mounted to the printed circuit board.

17 Claims, 9 Drawing Sheets

ELECTRICAL CONNECTOR HAVING MEANS FOR SECURELY MOUNTING THE CONNECTOR TO AN EDGE OF A PRINTED CIRCUIT BOARD

BACKGROUND OF THE INVENTION

1. Field of the Invention

The present invention relates to the art of an electrical connector, and particularly to an electrical connector having a locker which can be moved to a position sandwiching a printed circuit board (PCB hereinafter) on which the electrical connector is mounted thereby more securely connecting the connector and the PCB together.

2. Description of Related Art

It is well known to provide a right angle connector mountable to a printed circuit board (hereinafter PCB), in which the connector has terminals perpendicularly engaging with respective electrical circuit traces of the PCB. The terminals may have right angle solder tails projecting from a housing of the connector and inserted into holes in the PCB, or right angle solder tails extending generally parallel to the PCB for surface mounting to circuit traces on the PCB. Such a connector has a problem that the electrical connections between the terminals and the circuit traces of the PCB often are subjected to external stresses, specially including rotating force which causes the connector to rotate about the PCB. Such a rotation may cause the electrical connections between the terminals and the PCB to break. To resolve this problem, U.S. Pat. No. 5,692,912discloses the use of a tail-aligning device mountable on the housing to protect the solder tails of the terminals and to stabilize the connector.

However, with the ever-increasing lower-profile trend of electrical connector, along with simplification in assembly of the connector, the tail-aligning device often is impractical and neither cost nor space effective, due to having a plenty of apertures for the terminals to extend through.

Hence, an improvement to resolve the problems of the prior art is required.

SUMMARY OF THE INVENTION

Accordingly, an object of the present invention is to provide an electrical connector which can be securely mounted to an edge of a PCB.

Another object of the present invention is to provide an electrical connector which has improved signal transmission performance.

In order to achieve the objects set forth, an electrical connector in accordance with the present invention comprises an insulative housing with a front surface and a rear surface thereby defining a mating direction from the front surface to the rear surface, and a locker. The insulative housing defines a contact-receiving passageways and channels extending in the mating direction. A plurality of contacts is secured in the contact-receiving passageways and channels. Projections are configured in three parallel rows on a bottom surface of the housing. The locker comprises an inner surface being attached to the housing and a plurality of grooves depressed from the inner surface. Each groove defines a protrusion to engage corresponding projections of the housing during mounting the connector to an edge of a PCB.

Before the connector is mounted to the edge of the PCB, the protrusions of the locker are positioned between first and second rows of the projections of the connector. After the connector is mounted to the edge of the PCB, the locker is moved toward the rear surface of the insulative housing of the connector to reach a finally assembled position at which the protrusions slide over third row of the projections and fixedly engage therewith. At the finally assembled position, the locker sandwiches the edge of the PCB, whereby the connector and the edge of the PCB are more securely connected together and a possible rotation of the connector about the PCB is prevented.

The contacts of the connector are divided into power contacts and signal contacts. The signal contacts include two differential pairs of signal contacts separated by three ground contacts whereby the problem of signal transmission skew/propagation problem can be effectively solved. One of the three ground contacts is located between the two pairs of signal contacts, and the other two are located respectively at two sides of the two pairs of signal contacts.

Other objects, advantages and novel features of the invention will become more apparent from the following detailed description when taken in conjunction with the accompanying drawings.

DETAILED DESCRIPTION OF THE INVENTION

Figure 1:
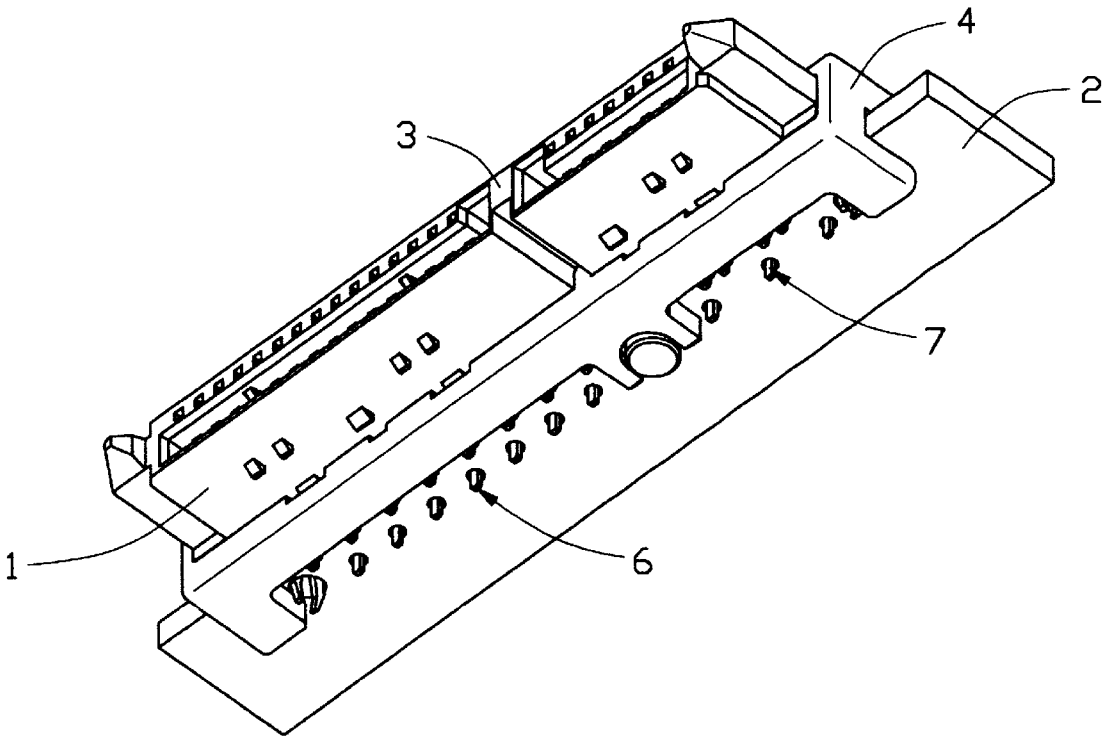
FIG. 1 is a bottom perspective view of an electrical connector in accordance with the present invention mounted to a printed circuit board.
Figure 2:
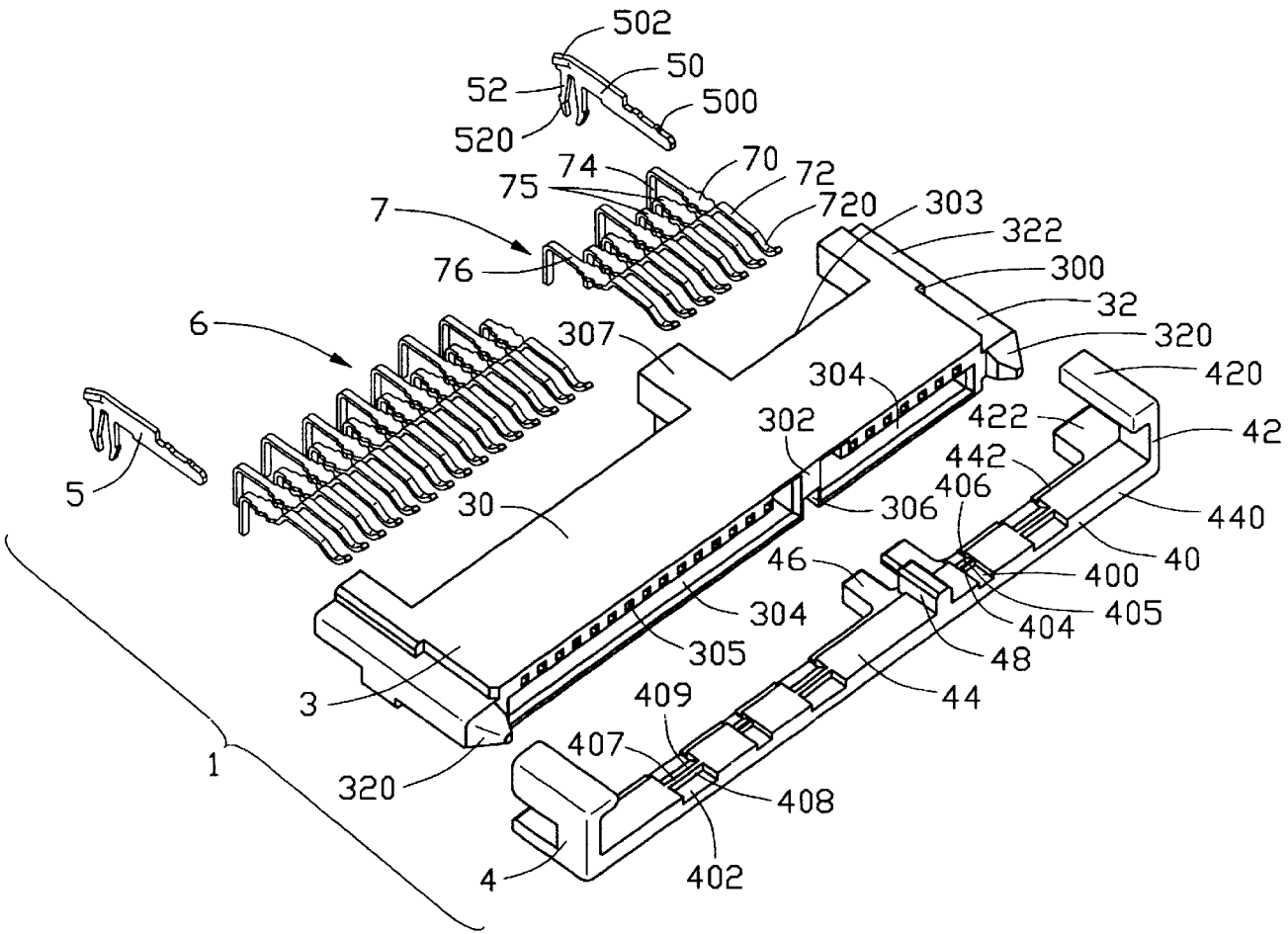
FIG. 2 is a top exploded view of the electrical connector.
Figure 3:
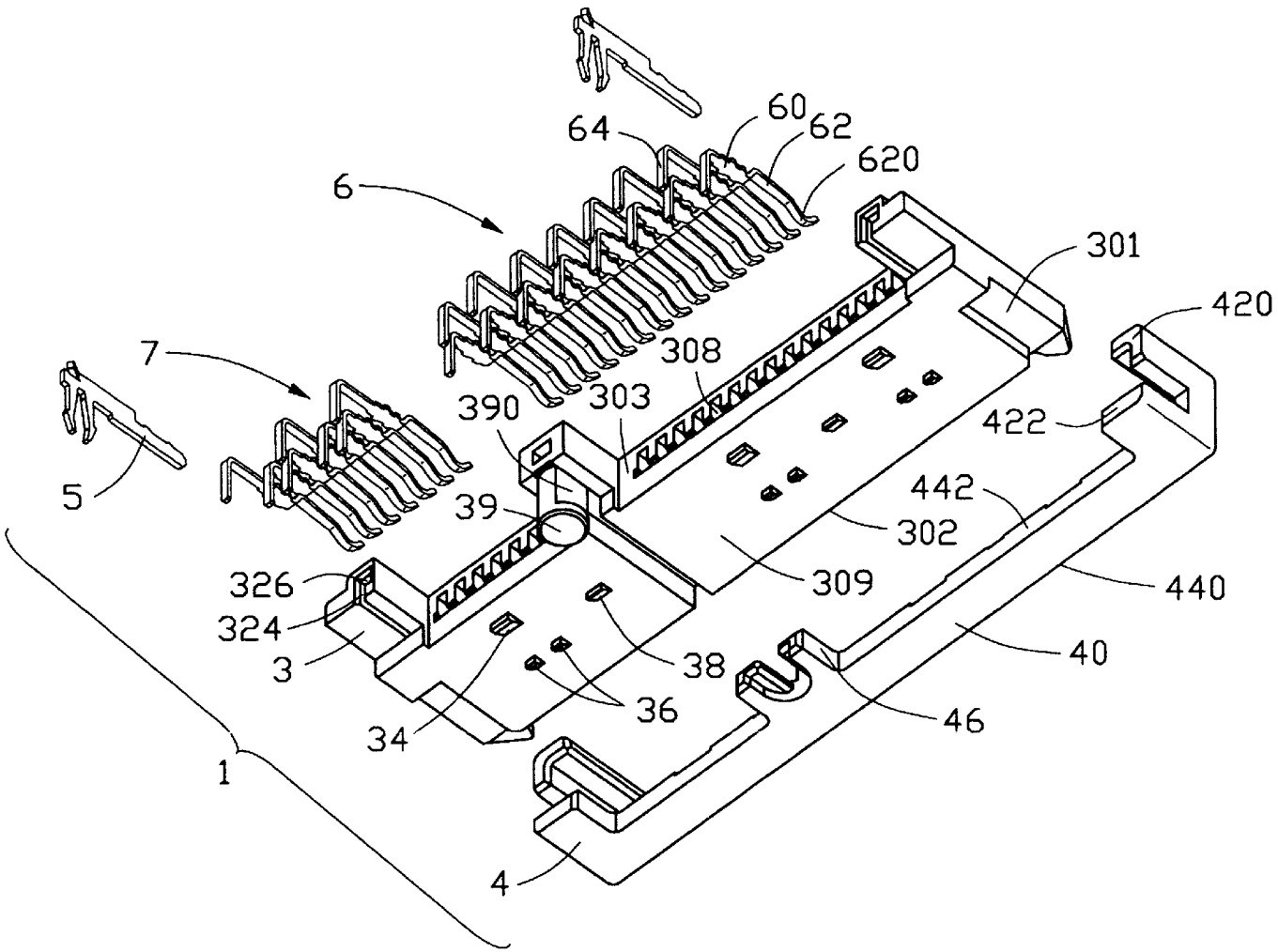
FIG. 3 is a bottom exploded view of the electrical connector.

Referring first to FIGS. 1–3, an electrical connector 1 of the present invention is mounted to a PCB 2 of a hard disk (not shown) whereby information can be transmitted between the hard disk and another electronic device electrically connecting with the connector 1. The connector 1 comprises an insulative housing 3, a locker 4 surrounding the housing 3, a plurality of power and signal contacts 6, 7 received in the insulative housing 10, and a pair of latches 5. The insulative housing 10 defines a base 30 having a front surface 302, a rear surface 303 and a bottom surface 309. The housing 3 further comprises two cavities 304 in the front surface 302 divided by a partition (not labeled) for receiving corresponding portions of a complementary connector (not shown), a plurality of passageways 305 exposed to the cavities 304, and a plurality of channels 308 defined by numbers of interlayers (not labeled), each channel 308 extending rearwardly from a rear end of a corresponding passageway 305, wherein the cavities 304, passageways 305 and channels 308 communicate together to define a contact-receiving space. A passage 306 is defined between the two cavities 304. A pair of leading arms 32 is defined at opposite sides of the housing 3 and extends in a mating direction (from the rear surface 303 to the front surface 302). Each leading arm 32 includes a tapered portion 320 beyond the front surface 302 and a rear portion 322 beyond the rear surface 303. The rear portion 322 forms a slot 324, and an engaging space 326 positioned at a side of the slot 324 and communicating with the slot 324. Between each leading arm 32 and the base 30, a first recess 300 and a second recess 301 are defined for retention of the locker 4. A hollow portion 307 projects rearwardly from a middle of the base 30, and a post 39 further extending downwardly from the hollow portion 307. The post 39 has two parallel lateral surfaces 390.

The base 30 defines three rows of projections designated 34, 36 and 38 beyond the bottom surface 309. In this embodiment, there are three first projections 34, three pairs of second projections 36 and two third projections 38. In addition, along the mating direction, each first projection 34 is arranged between a corresponding pair of second projections 36, and the row of the third projections 38 is located between the rows of the first and second projections 34, 36. Each projection 34, 36 and 38 has a vertical surface adjacent to the rear surface 303 for locking the locker 4 to the housing 3, and an inclined surface adjacent to the front surface 302 for facilitating the locker 4 to slide over the projections 34, 36, 38 when the locker 4 is assembled to the housing 3.

The locker 4 comprises a main body 40 with front surface and rear surface, and a pair of retaining frames 42 respectively at lateral ends of the main body 40. The main body 40 has an inner surface 44, a plurality of first grooves 400 and second grooves 402 in the inner surface 44. The second grooves 402 are wider than the first grooves 400. First protrusions 404 and second protrusions 407 are respectively formed in the first and second grooves 400, 402. Each first protrusion 404 forms a vertical surface 405 adjacent to the front surface 440 and an inclined surface 406 adjacent to the rear surface 442. Each second protrusion 404 has the same structure as the first protrusion 404, and includes a vertical surface 408 adjacent to the front surface 440 and an inclined surface 409 adjacent to the rear surface 442. Each retaining frame has a first wall 420 and a second wall 422 parallel to each other thereby sandwiching the leading arm 32 of the housing 3 therebetween. Adjacent to middle of the main body 40, a pair of fingers 46 extends rearward, while a rib 48 projects upwardly from the inner surface 44.

Each power contact 6 has a retention portion 60, a contact portion 62 projecting forward from the retention portion 60, and a tail portion 64 for mounting on the PCB 2. The contact portion 62 further defines a curved front end portion 620 for engaging a complementary connector. The signal contacts 7 and the power contacts 6 have similar structure. Each signal contact 7 has a retention portion 70, a contact portion 72 with an end portion 720, and a tail portion 74 for mounting on the PCB 2. Each latch 5 has a trunk 50 and a pair of legs 52 extending downwardly from a bottom side of a rear end of the trunk 50. Two teeth 500 are formed on a top side of a front end of trunk 50 of each latch 5. In addition, a laterally bent portion 502 is formed at the rear end of the trunk 50 of each latch 5. Each leg 52 has a barb 520 for enhancing engagement with the PCB 2.

Figure 4:
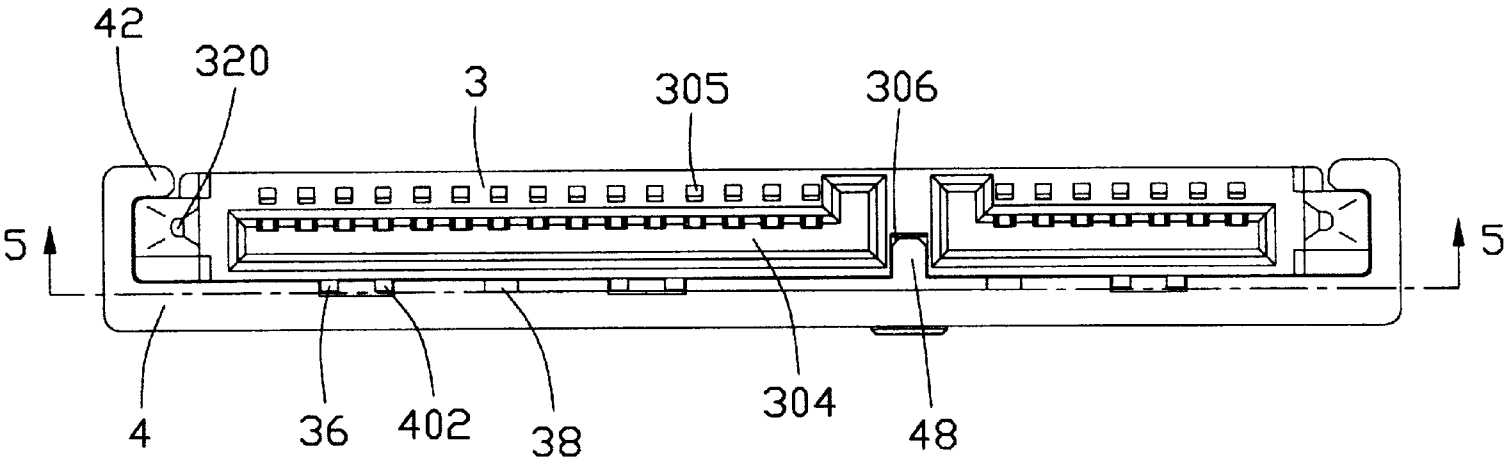
FIG. 4 is a front plan view of the electrical connector.
Figure 5:
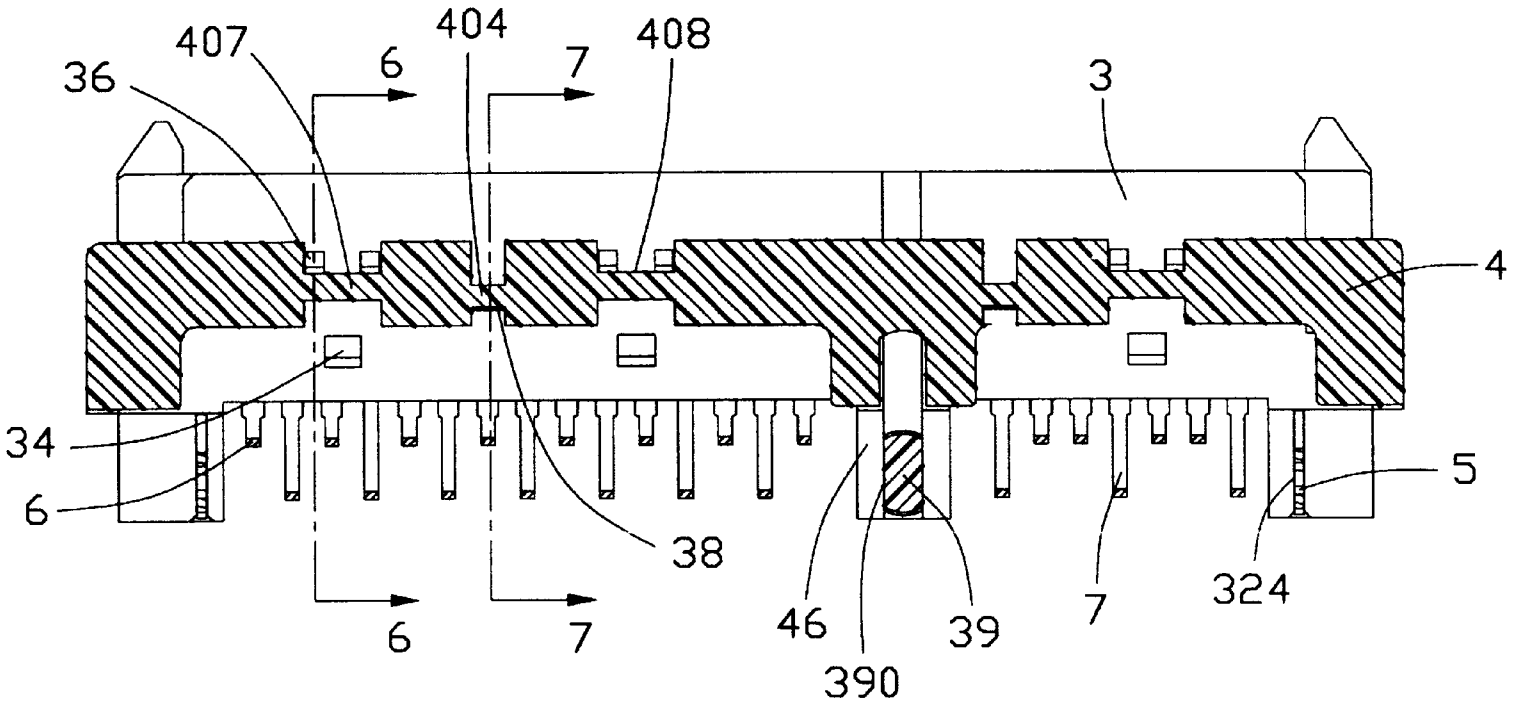
FIG. 5 is a cross-sectional view of the electrical connector taken along line 5—5 of FIG. 4.
Figure 6:
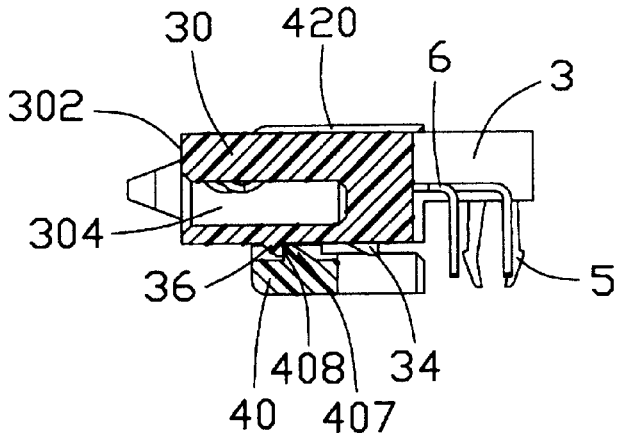
FIG. 6 is a cross-sectional view of the electrical connector taken along line 6—6 of FIG. 5.
Figure 7:
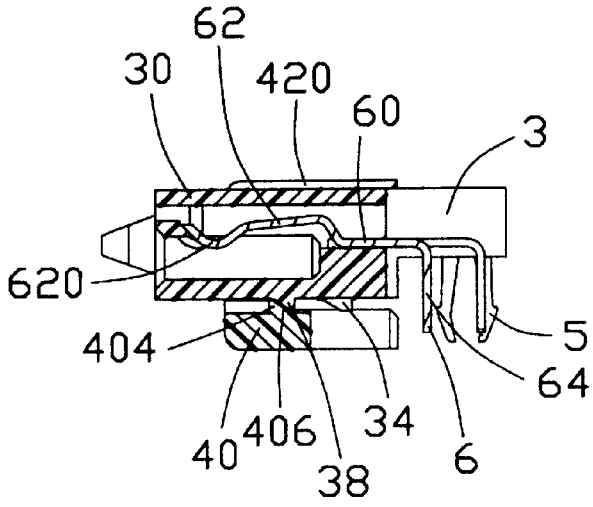
FIG. 7 is a cross-sectional view of the electrical connector taken along line 7—7 of FIG. 5.

FIG. 4 illustrates how the locker 4, the latches 5 and the contacts 6 and 7 are assembled to the housing 3 of the connector 1 of the present invention. With reference to FIGS. 5–7, the locker 4 is assembled to the housing 3 from the front surface 302 to the rear surface 303. The latches 5 and the contacts 6 and 7 are inserted into the housing 3 from the rear surface 303 to the front surface 302. The contacts 6 and 7 are inserted into the channels 308 of the housing 3 until the contact portions 62 and 72 of the contacts 6 and 7 are located in the passageways 305. The barbs of the retention portions 60, 70 of the contacts 6, 7 bite into the housing 3, and the tail portions 64 and 74 are exposed beyond the rear surface 303 of the housing 3 for soldering to the PCB 2. The latches 5 are inserted into corresponding slots 324 of the housing 3. The teeth 500 bite into the housing 3, and the bent portions 502 engage in the engaging spaces 326, thereby to securely fix the latches 5 to the housing 3. The leading arms 32 each engage a corresponding retaining frame 42, and are surrounded by a corresponding first wall 420 or second wall 422 of the retaining frame 42. The rib 48 is fitted in the passage 306, whereby the post 39 is fitted in the pair of fingers 46. In this way, the locker 4 is retained to the housing 3.

To ensure the locker 4 to be reliably retained to the housing 3, the three rows of projections 34, 36 and 38 serve as retention means during different stages of attachment of the locker 4 to the housing 3. As shown in FIGS. 5–7, during the movement of the locker 4 in the mounting process, the vertical surface 408 of the second protrusions 407 first engages corresponding vertical surface of the second projections 36, and the locker 4 therefore cannot separate from the housing 3 in a reverse direction (i.e., toward the front surface 302 of the housing 3). At the same time, the inclined surface of the first protrusions 404 locates on corresponding inclined surface of the third projections 38. At this position, a rear face of the retaining walls 42 of the locker 4 is in line with the rear surface 303 of the base 30 so that the connector 1 together with the locker 4 can be mounted to an edge of the PCB 2 by having the post 30, the legs 52 of the latches 4 and the tail portions 64, 74 of the contacts 6, 7 fitted into corresponding holes of the PCB 2. The tail portions 64, 74 are then soldered to the PCB 2. Referring back to FIG. 2, the signal contacts 7 consist of two differential pairs of signal contacts can be as short as possible so as to improve the problem signal skew/propagation delay.

Figure 8:
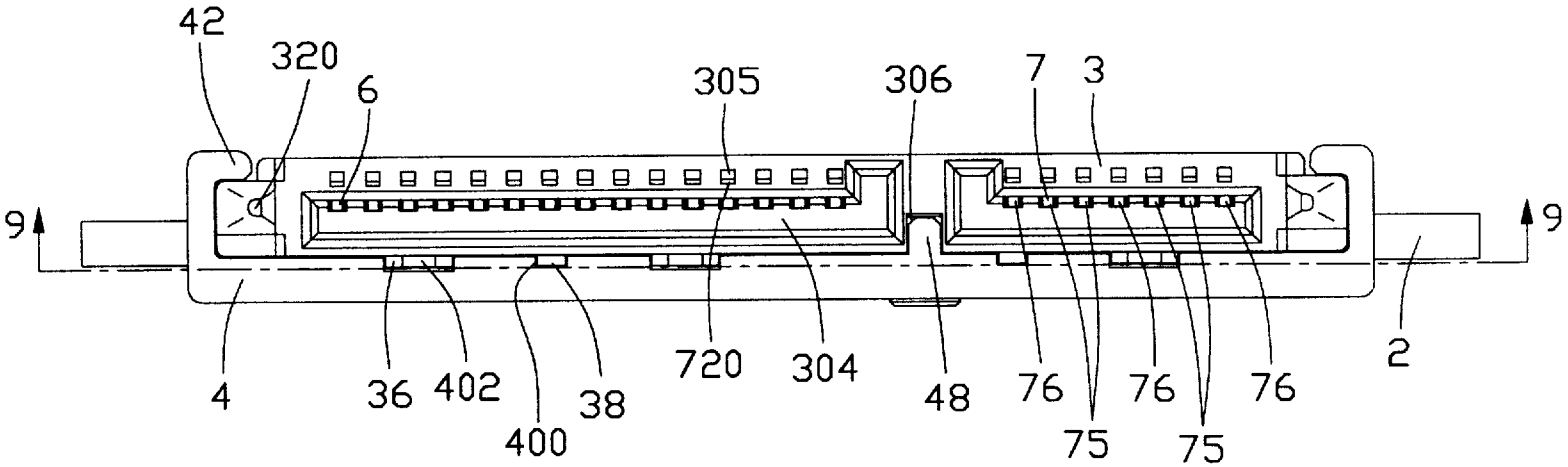
FIG. 8 is a view similar to FIG. 4, but including a printed circuit board attached to the connector.
Figure 9:
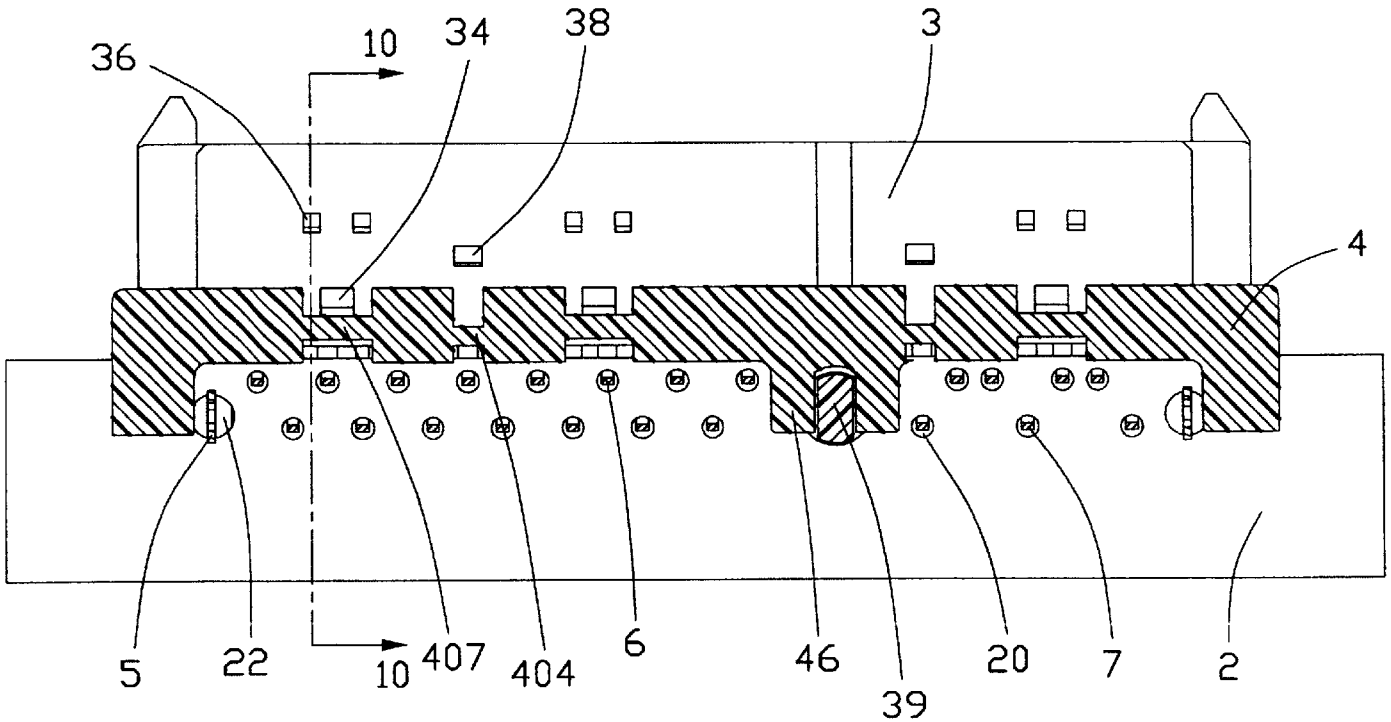
FIG. 9 is a cross-sectional view taken along line 9—9 of FIG. 8.
Figure 10:
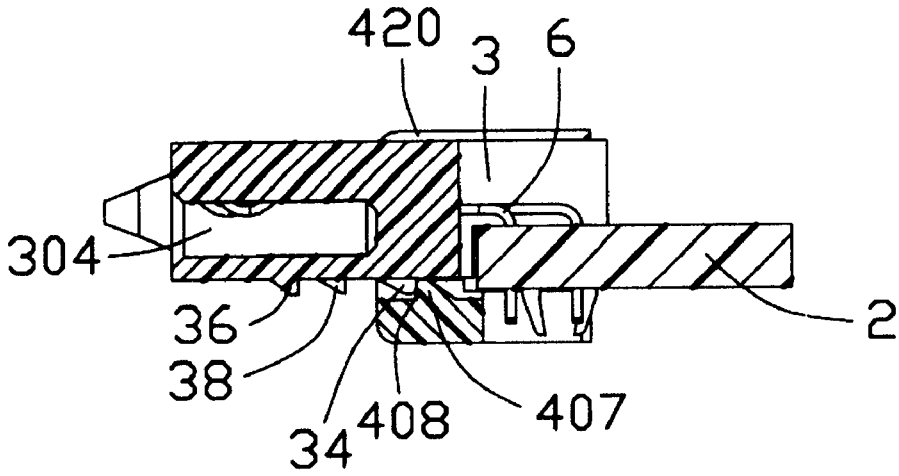
FIG. 10 is a cross-sectional view taken along line 10—10 of FIG. 9.

FIGS. 8–10 show the locker 4 having been completely moved the finally assembled position, along the mating direction to enforce the connection between the connector 1 and the PCB 2. After the connector 1 is mounted to the PCB 2 and the locker 4 is located at the position of FIGS. 5–7, the locker 4 is further moved rearwards on the connector 1 so that the inclined surface 406 of the first protrusions 404 slide over the inclined surface 38 and then the first projections 34 to reach the finally assembled position at which the vertical surface 408 of the second protrusions 407 engages with the vertical surface of the first projections 34. At this position, also referring to FIGS. 1 and 3, the edge of the PCB 2 is sandwiched between the first and second walls 420, 422 of the locker 4 and between the hollow portion 307 of the housing 3 and the fingers 46 of the locker 4, whereby the connector 1 and the PCB 2 are securely connected together, and a possible rotation of the connector relative to the PCB is prevented.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a printed circuit board comprising:

an elongated housing having a front surface, a rear surface, a plurality of contact-receiving passageways extending between the front and rear surfaces, and first, second and third rows of projections;

a plurality of contacts secured in the contact-receiving passageways of the housing; and a locker having an inner surface being attached to the housing and a plurality of grooves depressed from the inner surface, each groove defining a protrusion, the protrusions being retained between the first and second rows of projections before the connector is mounted to the printed circuit board, and moved to securely engage with the third row of projections after the connector is mounted to the printed circuit board so as to prevent tilting of the connector relative to the printed circuit board about a lengthwise direction of the connector.

2. The electrical connector as described in claim 1, wherein the housing further defines a pair of leading arms extending from both sides of the housing and beyond the front surface and rear surface of the housing.

3. The electrical connector as described in claim 2, wherein the locker defines a pair of retaining frames at both sides thereof for respectively engaging the leading arms of the housing, and each retaining frame engaging the printed circuit board after the connector is mounted to the printed circuit board.

4. The electrical connector as described in claim 3, wherein the contacts are grouped into signal contacts and power contacts, the signal contacts consisting two differential pairs of signal contacts for signal transmission and three ground contacts alternating with the two differential pair of signal contacts.

5. The electrical connector as described in claim 1, wherein each of the protrusions of the locker has a vertical surface and an inclined surface.

6. The electrical connector as described in claim 5, wherein the projections of the housing each have a vertical surface and an inclined surface.

7. The electrical connector as described in claim 6, wherein the first, second and third rows of projections are arranged parallel to the front and rear surfaces of the housing.

8. The electrical connector as described in claim 6, wherein the protrusions of the locker are arranged in rows and parallel to the front and rear surfaces of the housing.

9. The electrical connector as described in claim 1, wherein the housing having an body portion and a mating portion projecting from the body portion, the passageways being defined in the body portion and the mating portion.

10. The electrical connector as described in claim 9, wherein each contacts has a contact portion received in corresponding passageway and a tail portion extending beyond the rear surface.

11. A method for mounting an electrical connector to an edge of a printed circuit board, the connector comprising a plurality of contacts and a locker slidably mounted thereon at an initial position, comprising:

a) electrically connecting the contacts to the printed circuit board; and b) sliding the locker to a final position at which the edge of the printed circuit board is sandwiched between the locker and the connector, whereby a rotation of the connector relative to the printed circuit board is prevented.

12. The method as described in claim 11, wherein the connector has first, second and third parallel rows of projections, and the locker has a row of protrusions, and at the step b), the protrusions of the locker being moved from a position between the first and second rows of projections to a position securely engaging the third rows of projections.

13. The method as described in claim 12, wherein the connector has a rearward extending hollow portion, a post extending downwardly from the hollow portion and at the step a) the post being fitted into the printed circuit board, and at the step b), the edge of the printed circuit board being sandwiched between the hollow portion and the locker.

14. An electrical connector assembly comprising:

a printed circuit board defining a plurality of through holes around an edge portion thereof;

an electrical connector including:

an insulative housing with a plurality of contacts therein, said housing with the associated contacts mounted on the edge portion of the printed circuit board, in a vretical direction, with tails of the contacts extending into the through holes, respectively; and a locker slidable in a horizontal direction perpendicular to said vertical direction with means for securing to the housing and means for snuggly receiving the edge portion of the printed circuit board between the locker and the housing, so as to prevent tilting of the connector relative to the printed circuit board about a lengthwise direction of the connector perpendicular to both said vertical direction and said horizontal direction.

15. The connector assembly as described in claim 14, wherein said locker is already preliminarily attached to the housing before the housing is mounted to the edge portion of the printed circuit board, while such attachment does not obstruct mounting of the housing onto the edge portion of the printed circuit board.

16. An electrical connector assembly comprising:

an insulative housing;

a plurality of right angle type contacts disposed in the housing;

a locker slidably mounted on the housing, said housing and said locker together defining a first relative position for a situation before the housing with the associated contacts are mounted on a front edge of a printed circuit board, and a second relative position for another situation once the housing with the associated contacts have been mounted on the front edge of the printed circuit board, with the edge of the printed circuit board being sandwiched between the locker and the housing; and means for mutually exclusively retaining the housing and the locker at said first or said second relative positions.

17. The connector assembly as described in claim 16, wherein said locker further defines a notch structure for grasping the front edge of the printed circuit board on which the contacts are mounted.

* * * * *